US010399377B2

(12) United States Patent
Sczepan et al.

(10) Patent No.: US 10,399,377 B2
(45) Date of Patent: Sep. 3, 2019

(54) METHOD FOR PROVIDING A ROLLER ASSEMBLY FOR CREATING DECORATIVE PATTERNS ON A WOOD MATERIAL SURFACE

(71) Applicant: Flooring Technologies Ltd., Kalkara (MT)

(72) Inventors: Ralf Sczepan, Essen (DE); Roger Braun, Willisau LU (CH)

(73) Assignee: Flooring Technologies, Ltd., Kalkara (MT)

( * ) Notice: Subject to any disclaimer, the term of this patent is extended or adjusted under 35 U.S.C. 154(b) by 140 days.

(21) Appl. No.: 15/427,400

(22) Filed: Feb. 8, 2017

(65) Prior Publication Data

US 2017/0144475 A1 May 25, 2017

Related U.S. Application Data

(63) Continuation-in-part of application No. 12/209,448, filed on Sep. 12, 2008, now abandoned.

(30) Foreign Application Priority Data

Sep. 17, 2007 (DE) ..... 10 2007 044 261

(51) Int. Cl.

| | |
|---|---|
| ***B44C 5/04*** | (2006.01) |
| ***B05D 1/28*** | (2006.01) |
| ***B44C 1/24*** | (2006.01) |
| ***B44F 9/02*** | (2006.01) |
| ***B27N 7/00*** | (2006.01) |
| ***B41M 1/24*** | (2006.01) |
| ***B41M 1/38*** | (2006.01) |
| ***B44D 5/00*** | (2006.01) |
| *B41M 1/14* | (2006.01) |

(52) U.S. Cl.

CPC ..... *B44C 5/043* (2013.01); *B05D 1/28* (2013.01); *B27N 7/005* (2013.01); *B41M 1/24* (2013.01); *B41M 1/38* (2013.01); *B44C 1/24* (2013.01); *B44D 5/00* (2013.01); *B44F 9/02* (2013.01); *B41M 1/14* (2013.01)

(58) Field of Classification Search

CPC .. B44C 1/24; B44C 5/043; B44F 9/02; B05D 1/28

See application file for complete search history.

(56) References Cited

U.S. PATENT DOCUMENTS

| | | | | |
|---|---|---|---|---|
| 6,685,993 | B1 * | 2/2004 | Hansson | B32B 5/30 427/551 |
| 2004/0086736 | A1 * | 5/2004 | Amin-Javaheri | B44D 5/00 428/500 |
| 2007/0141328 | A1 * | 6/2007 | Kamiyama | B32B 3/30 428/343 |
| 2009/0130311 | A1 * | 5/2009 | Brull | B44F 9/02 427/275 |

FOREIGN PATENT DOCUMENTS

| | | | | |
|---|---|---|---|---|
| WO | WO-2006045763 | A2 * | 5/2006 | B44F 9/02 |

* cited by examiner

*Primary Examiner* — Nathan H Empie

(74) *Attorney, Agent, or Firm* — Bachman & LaPoint, PC

(57) ABSTRACT

A method for providing a roller assembly for producing a decorative pattern on a wood material surface, wherein the roller assembly comprises at least one decorative paint roller and at least one structured lacquer application or embossing roller, and the structured lacquer application or embossing roller and the decorative paint roller are matched to create a structured decorative pattern, includes the steps of applying first the decorative paint roller and then the structured lacquer application roller on the wood material surface. The method uses at least two different decorative paint rollers for creating two different decorative patterns are matched with a structured lacquer application or embossing roller.

6 Claims, No Drawings

METHOD FOR PROVIDING A ROLLER ASSEMBLY FOR CREATING DECORATIVE PATTERNS ON A WOOD MATERIAL SURFACE

CROSS REFERENCE TO RELATED APPLICATION

This application is a continuation-in-part of Ser. No. 12/209,448, filed Sep. 12, 2008.

BACKGROUND (1) Field of Invention

The present invention relates to a method for providing a roller assembly for creating decorative patterns on a wood material surface, and for using the roller assembly to create decorative patterns on wood material surfaces.

(2) Prior Art

Wood material surfaces, such as those processed to panels, are usually surface coated. Apart from desirable properties, such as the resistance against wear and tear, and the protection against moisture, achieving a certain attractive outward appearance is also desired. Typical wood materials are chip board, high- and medium-density fiberboard, plywood and OSB board, however, in the context of the present invention, also solid wood and solid wood boards are counted amongst the wood materials.

Coating methods known from the prior art include not only methods wherein synthetic resins are pressed together with the wood material, but also those wherein at least one, usually, however, a plurality of paint or lacquer coats are applied in liquid form, which are subsequently dried or hardened. Such a coating method is relatively cheap and simple. To apply the individual coats, preferably rollers are used, which roll on the wood material surface and thereby transfer the previously received liquid paint or lacquer (indirect gravure printing).

A typical structure of such a coating comprises first a primer, followed by a decorative paint coat, on which, in turn, one or more finishing lacquer coats are applied. The lacquer coats complete the surface coating. While the colored appearance is provided by the decorative coat and sometimes also by the primer, the surface properties, such as roughness and reflective behavior, are determined by the finishing lacquer coats. Different lacquer coats can also have different opacities.

Sometimes it may be desirable to structure the surface in a three-dimensional manner, either by means of an optical effect, or by forming the surface in a three-dimensional manner. When liquid paint or lacquer coats are applied without a subsequent pressing process, real three-dimensional forming of the surface is difficult, but it is possible to provide optical structuring, by applying, for example, lacquer coats having different properties in different areas, in particular having a different degree of gloss. It is thus possible to provide a surface having no unevenness with a three-dimensional appearance.

In particular with imitation wood, it is often desirable not only to imitate the pore structure of the wood to be imitated by means of colored paint, but to give it a more realistic appearance by using, for example, matt lacquer to highlight the pores and glossy lacquer for the areas surrounding them, to give an approximately three-dimensional impression. For this purpose it is necessary, however, to apply each of the two types of lacquer with its own roller. At least one of these rollers must have a surface structure, so that it applies lacquer to the wood material surface only with portions of its surface. A roller with a surface, which applies lacquer only in portions, for example, for creating optical pores, will be referred to as a structured lacquer application roller in the following.

For a realistic, consistent optical appearance, the pore pattern which is evoked by the top lacquer coats must be matched with the underlying decorative paint coat. To achieve this it is necessary according to the prior art to provide a structured lacquer application roller for each of the roller or rollers used for a decorative paint coat, referred to as decorative paint rollers in the following, whereby the lacquer application roller has to be matched to the decorative paint pattern produced by the decorative paint rollers in such a way, that together they create a decorative pattern having a three-dimensional effect. This causes the problem that the design, and in particular the precise production of a structured plate involves time and cost with each new decorative pattern. Providing such roller assemblies of decorative paint rollers and structured lacquer application rollers for each decorative pattern separately is very cumbersome.

SUMMARY OF THE INVENTION

It is therefore the object to provide a simplified method for providing a roller assembly to produce a decorative pattern.

This problem is solved according to the present invention by a method for providing a roller assembly for producing a decorative pattern on a wood material surface and by a method using this set of rollers to produce decorative patterns on wood material surfaces.

The method is characterized in that at least two different decorative paint rollers are matched to a structured lacquer application roller to produce two different decorative patterns. For this purpose it is first determined which decorative colored paint patterns allow compatible surface designs, for example, which types of wood have a similar pore structure. Subsequently, the exact structure of the structured lacquer application roller is determined, to which the precise appearance of the different decorative colored paint patterns is matched.

In a further aspect, the invention includes a method for producing a method for producing at least two color patterns coordinated with one structure on wood material surfaces, comprising the steps of: providing a roller assembly comprising at least a first decorative paint roller for transferring a first color pattern to a first wood material surface, and a second decorative paint roller for transferring a second color pattern to a second wood material surface, wherein the first color pattern and the second color pattern are different from each other and comprise different pore structures, wherein the different pore structures at least partially coincide; providing at least one structured lacquer application or embossing roller comprising a structure of pores common to all rollers of the roller assembly, and wherein the at least one structured lacquer application or embossing roller and the first decorative paint roller are matched for creating a first structured decorative pattern, and wherein the at least one structured lacquer application or embossing roller and the second decorative paint roller are matched for creating a second structured decorative pattern different from the first structured decorative pattern; applying said first decorative paint roller and subsequently the at least one structured lacquer application or embossing roller to the first wood material surface for creating said first structured decorative pattern; changing only said first decorative paint roller to said second decorative paint roller; and applying said second decorative paint roller and subsequently the at least one structured lacquer application or embossing roller to the second wood material surface for creating said second structured decorative pattern.

In this way, the effort involved in developing and producing the structured lacquer application roller has to be made only once for a group of decorative patterns. This saves money and also time, all the more the greater the number of decorative colored paint patterns that correspond to a single structured lacquer application roller.

Time will also be saved in the production process since the structured lacquer application roller does not have to be changed during a switchover to a different decorative pattern. This is a substantial advantage, in particular, when it can be achieved that those types of decorative patterns which are particularly popular are matched in the above mentioned manner to one and the same structure of a single lacquer application roller.

In one preferred embodiment of the method, in addition to the decorative paint rollers and the structured lacquer application roller, at least one primer roller is provided allowing a prime coat to be applied prior to the application of a decorative pattern. This is often necessary or at least advantageous since many paints may not, or only with very bad results, be applied to an unprimed wood material surface.

For multi-color decorative patterns, the use of a single decorative paint roller does not suffice, in this case a different decorative paint roller will be used for each paint to be applied. This is why in an embodiment of the method, two or more decorative paint rollers will be used to create the decorative pattern.

In many cases, the lacquers used for applying a pattern to the surface in the different areas of the decorative pattern to be created are mutually incompatible in an undesirable manner when successively applied to one and the same surface. For this reason—or to highlight more strongly the desired three-dimensional effect by the application of different lacquers—in the present method, preferably two or more structured lacquer application rollers are provided to create a decorative pattern. Each of these rollers is selectively used to pattern certain portions of the wood material surface.

The use of both structured and non-structured lacquer application rollers, enables different patterning possibilities. For example, after applying a primer and a decorative pattern, a clear coat may first be applied over the entire surface, and subsequently, in certain portions of the surface, a matt lacquer, a glazing or a tinted coat may be applied on top of the clear coat. By these means, certain structures of the decorative colored paint pattern may be highlighted and will be provided with a more realistic or more interesting appearance. In such cases, according to a further preferred embodiment of the method, a non-structured lacquer application roller is additionally provided, which acts on the entire wood material surface.

It is also conceivable to apply one or more non-structured lacquer coats after the application of the structured lacquer coats. For this purpose, a non-structured lacquer application roller can also be provided.

Apart from the approach of only changing the appearance of the surface, it is also possible to emboss a certain, actually three-dimensional structure on the surface, which will thus not only be visible, but may also have a tangible structure, resulting, for example, in an even more realistic imitation of a wood surface. According to a further embodiment of the method, on the surface of a structured embossing roller, structures will be created, by means of which a coated or uncoated wood material surface may be plastically deformed.

A further aspect of the invention relates to a method for producing at least two color patterns coordinated with one structure on wood material surfaces, comprising the steps of: providing a roller assembly comprising at least a first decorative paint roller for transferring a first color pattern to a first wood material surface, and a second decorative paint roller for transferring a second color pattern to a second wood material surface, wherein the first color pattern and the second color pattern are different from each other and comprise different pore structures, wherein the different pore structures at least partially coincide; providing at least one structured lacquer application or embossing roller comprising a structure of pores common to all rollers of the roller assembly, and wherein the at least one structured lacquer application or embossing roller and the first decorative paint roller are matched for creating a first structured decorative pattern, and wherein the at least one structured lacquer application or embossing roller and the second decorative paint roller are matched for creating a second structured decorative pattern different from the first structured decorative pattern; applying said first decorative paint roller and subsequently the at least one structured lacquer application or embossing roller to the first wood material surface for creating said first structured decorative pattern; changing only said first decorative paint roller to said second decorative paint roller; and applying said second decorative paint roller and subsequently the at least one structured lacquer application or embossing roller to the second wood material surface for creating said second structured decorative pattern.

DETAILED DESCRIPTION OF THE PREFERRED EMBODIMENT(S)

Details of the present invention will be explained in more detail in the following with reference to practical examples.

Example 1

To imitate the three types of wood, i.e. oak, ash and elm, rollers are provided to pattern the surfaces of hardboard panels. For this purpose, three imitations of wood surfaces are designed by means of image processing software on a computer, wherein the pore structure of the three imitations is adapted to each other, if necessary in a stepwise manner. This does not necessarily mean that the form and the position of all pores is coincident in all three imitations, but the positions at least partially coincide.

While on the basis of the three thus created image files two structured decorative paint rollers are produced per type of wood (oak, ash, elm) by means of computer-aided manufacture for the application of paint, a fourth image file is created on the basis of the three image files for imaging the structure of the pores, common to all three imitations. On the basis of this fourth image file, a single structured lacquer application roller is produced, again in a computer-aided manner.

To create the imitation oak surface, a commercially available colored primer is first applied to the high density fiber board by means of a roller. The color of the primer matches the color of the decorative oak pattern later to be applied. The application amount is about 14 g/m$^2$. This primer fills roughnesses, smoothes fibers and improves the water repellent properties of the high density fiber board.

To create the decorative oak pattern, a paint in a first brown tone in a coat thickness of 15 g/m$^2$ is applied on top of the primer by means of a first decorative paint roller, and a paint in a second brown tone in a coat thickness of 17 g/m$^2$ is applied by means of a second decorative paint roller. The decorative paint rollers are structured to ensure selective paint application. In combination with the primer, the applied paints imitate the colored structure of the oak surface.

A first and a second layer of clear lacquer are then applied on top of the decorative pattern by means of two non-structured rollers. Each time 30 g/m$^2$ of lacquer which hardens under UV light is first applied, and then hardening is initiated under the effect of UV light, but not completed. On a partially hardened first lacquer coat, the second lacquer coat is then applied. This lacquer coat is also exposed to UV light, but not completely hardened. Both lacquer coats have corundum added to them.

On these two first lacquer coats, finally a UV-hardening finishing coat is applied with a layer thickness of 12 g/m$^2$.

Finally, by means of the structured lacquer application roller, an also UV-hardening matt lacquer is applied in portions on the finishing coat, wherein the structure of the roller at least partially coincides with the pore structure defined by the decorative colored paint pattern. As a result of this, the respective pore imitations will appear more realistic, since the impression of indentations in the surface is created by means of the different reflective behavior. The subsequently used UV light finally hardens all three or four applied lacquer coats, which is easily possible because of the small applied amounts overall.

To create an imitation ash surface, the decorative paint rollers are exchanged for paint application, while the roller for applying the primer remains the same. Only the color of the primer must sometimes be changed. The non-structured lacquer application roller for applying the clear lacquer coats and the structured lacquer application roller for applying the matt lacquer can also remain the same. The latter is possible since the colored paint pattern for ash applied by the new decorative paint rollers is matched according to the present invention to the pore structure of the roller for matt lacquer. Since the removal and the replacement of the structured lacquer application roller is omitted, the changeover process from one decorative pattern to a different one takes less time, which means that the production needs to be stopped for a shorter period of time. This leads to considerable cost savings in particular with frequent changeovers.

The process of paint or lacquer application is otherwise the same as with the imitation oak. To switch over the machine to the decorative elm pattern, again only the two decorative paint rollers need to be exchanged.

Example 2

Floor boards with a rustic pattern in the three previously mentioned types of wood, i.e. oak, elm, ash, are to be produced with a surface having a used look.

Three imitations of wood surfaces are designed again on a computer using image processing software, wherein the pore structures again match each other in the above-mentioned fashion. A fourth image file is created for imaging the structure of the pores, common to all three imitations.

In addition, a fifth image file with color patterns is created to imitate dirt, drag marks and scratch marks. These damage patterns are to be superimposed with the three individual decorative colored patterns, i.e. the form and the positions of the dirt, the drag marks and scratch marks are the same for all three types of wood.

Based on the first three image files, again, two structured decorative pattern rollers are produced per type of wood by means of computer-aided manufacture. On the basis of the fourth image file, again using computer-aided manufacture, a single first structured lacquer application roller is produced. Further, on the basis of the fifth image file, a second structured lacquer application roller and a structured embossing roller having raised portions corresponding to the indentations due to scratch marks etc. is produced.

The processes of priming and applying the paint are as in the first example. The same applies to the application of two clear lacquer coats and a finishing coat.

A UV-hardening clear matt lacquer is again applied in portions by means of the structured lacquer application roller, wherein the structure of the roller at least partially coincides with the pore structure defined by the decorative pattern. Subsequently, a tinted matt lacquer is applied by means of the second structured lacquer application roller, by means of which the structure of damage patterns is imitated on the surface on the one hand with color, and on the other hand by means of a different reflective behavior. Again, the lacquer coats are hardened together by means of UV light.

Subsequently, indentations corresponding to scratch marks and drag marks are embossed on the wood material surface at a pressure of 10 bar by means of the embossing roller. This serves both to create a more realistic outward appearance of the corresponding structures and on the other hand to make them haptically realizable, which completes the illusion.

To create the imitation ash surface, as in the first example, the decorative paint rollers are exchanged for paint application, while the roller for applying the primer, the non-structured lacquer application roller for applying the clear lacquer coats and the first structured lacquer application roller for applying the clear matt lacquer, remain the same. Also the second non-structured lacquer application roller for applying the tinted matt lacquer and the structured embossing roller can be kept the same, since according to the present invention, the usage marks have the same position and form on the imitation ash as on the imitation oak. Since the removal and replacement of the structured lacquer application rollers and the structured embossing rollers is omitted, again, the changeover process from one decorative pattern to another is less time-consuming.

The processes of applying the paint or lacquer and the embossing are the same as with the imitation oak. A different tinted matt lacquer than with the imitation oak is applied, however, with the second structured lacquer application roller, to take into account that corresponding damage marks on wood having a different color also appear in a different color. To change over the machine to the imitation elm, again, only the two decorative paint rollers need to be exchanged.

What is claimed is:

1. A method for producing at least two color patterns coordinated with one structure on wood material surfaces, comprising the steps of:

providing a roller assembly comprising at least a first decorative paint roller for transferring a first color pattern to a first wood material surface, and a second decorative paint roller for transferring a second color pattern to a second wood material surface, wherein the first color pattern and the second color pattern are different from each other and comprise different pore structures, wherein positions of at least some pores of the different pore structures are the same;

providing at least one structured lacquer application or embossing roller comprising a structure of pores common to all rollers of the roller assembly such that at least some pores of the structure of pores of the structured lacquer application or embossing roller are in the same position as pores of the pore structure of the first decorative paint roller and at least some pores of the structure of pores of the structured lacquer application or embossing roller are in the same position as pores of the pore structure of the second decorative paint roller, and wherein the at least one structured lacquer application or embossing roller and the first decorative paint roller are matched for creating a first structured decorative pattern, and wherein the at least one structured lacquer application or embossing roller and the second decorative paint roller are matched for creating a second structured decorative pattern different from the first structured decorative pattern;

applying said first decorative paint roller and subsequently the at least one structured lacquer application or embossing roller to the first wood material surface for creating said first structured decorative pattern;

changing only said first decorative paint roller to said second decorative paint roller; and applying said second decorative paint roller and subsequently the at least one structured lacquer application or embossing roller to the second wood material surface for creating said second structured decorative pattern; wherein the providing steps comprise the following steps: designing at least a first imitation of a wood surface and a second imitation of a wood surface different from the first imitation, wherein the first and second imitations include color patterns and pore structures, and wherein at least some pores of a pore structure of the first imitation are in the same position as at least some pores of a pore structure of the second imitation; producing the first decorative paint roller corresponding to the color patterns and pore structure of the first imitation; producing the second decorative paint roller corresponding to the color patterns and pore structure of the second imitation; and producing the at least one structured lacquer application or embossing roller having the structure of pores common to all rollers of the roller assembly.

2. The method according to claim 1, further comprising providing at least one priming roller, and applying the at least one priming roller to at least one of the first wood material surface and the second wood material surface to apply a prime coat prior to application of the first or second structured decorative pattern respectively.

3. The method according to claim 1, further comprising providing at least two structured lacquer application and/or embossing rollers to create the first and second structured decorative patterns on each of the first and second wood material surfaces.

4. The method according to claim 1, further comprising providing a non-structured lacquer application roller to apply a layer of lacquer on at least one of the first and second wood material surfaces.

5. The method according to claim 1, further comprising creating structures on the surface of the structured embossing roller, by means of which a coated or uncoated first or second wood material surface can be plastically deformed.

6. The method according to claim 1, further comprising creating structures on a surface of the at least one structured lacquer application or embossing roller which correspond to a pore pattern and which is matched to different wood imitation patterns created by said first decorative paint roller and said second decorative paint roller.

* * * * *